US008172484B2

(12) United States Patent
Tsukamoto

(10) Patent No.: US 8,172,484 B2
(45) Date of Patent: May 8, 2012

(54) FIBER REINFORCED PLASTIC DRILLING ANCHOR

(75) Inventor: Kenichi Tsukamoto, Meerbusch (DE)

(73) Assignee: FiRep Rebar Technology GmbH, Dusseldorf (DE)

( * ) Notice: Subject to any disclaimer, the term of this patent is extended or adjusted under 35 U.S.C. 154(b) by 433 days.

(21) Appl. No.: 12/302,215

(22) PCT Filed: May 29, 2007

(86) PCT No.: PCT/EP2007/004722

§ 371 (c)(1),
(2), (4) Date: Jul. 28, 2009

(87) PCT Pub. No.: WO2007/137807

PCT Pub. Date: Dec. 6, 2007

(65) Prior Publication Data

US 2009/0297278 A1 Dec. 3, 2009

(30) Foreign Application Priority Data

May 29, 2006 (DE) ..... 10 2006 025 248

(51) Int. Cl.
*E21D 21/00* (2006.01)

(52) U.S. Cl. ..... 405/259.1

(58) Field of Classification Search .... 405/259.1–259.6, 405/288, 302.1

See application file for complete search history.

(56) References Cited

U.S. PATENT DOCUMENTS

| | | | | | |
|---|---|---|---|---|---|
| 4,909,690 | A | * | 3/1990 | Gapp et al. | 411/411 |
| 4,955,758 | A | * | 9/1990 | Hyde | 405/259.1 |
| 4,958,961 | A | * | 9/1990 | Herbst et al. | 405/259.1 |
| 5,127,783 | A | * | 7/1992 | Moghe et al. | 411/411 |
| 5,249,898 | A | * | 10/1993 | Stepanski et al. | 405/259.6 |
| 5,314,268 | A | * | 5/1994 | Calandra et al. | 405/259.1 |
| 5,437,526 | A | * | 8/1995 | Herbst et al. | 405/259.5 |
| 2004/0136788 | A1 | * | 7/2004 | Hindle | 405/259.1 |

FOREIGN PATENT DOCUMENTS

| | | | |
|---|---|---|---|
| DE | 3504829 | * | 9/1986 |
| DE | 4018703 | C1 | 8/1991 |
| DE | 4018703 | W | 8/1991 |
| DE | 9407189 | U1 | 8/1994 |
| DE | 2951694 | U1 | 4/1995 |
| DE | 19828371 | A1 | 12/1999 |
| EP | 0191337 | A2 | 8/1986 |
| WO | 9621087 | A | 7/1996 |
| WO | 2007137807 | R | 8/2007 |

* cited by examiner

*Primary Examiner* — Frederic L Lagman

(74) *Attorney, Agent, or Firm* — Millen, White, Zelano & Branigan, P.C.

(57) ABSTRACT

The invention relates to a fiber-reinforced plastic drilling anchor comprising an axial bore that runs along the entire length thereof, fibers which extend in the longitudinal direction thereof, and fibers that extend at an angle to the longitudinal direction thereof. A first layer of fibers that extend at an angle to the longitudinal direction of the drilling anchor is surrounded by a second layer of fibers extending in the longitudinal direction of the drilling anchor, and the second layer of fibers is surrounded by a third layer of fibers extending at an angle to the longitudinal direction of the drilling anchor. The inventive drilling anchor further comprises a thread which extends along the entire length thereof and is molded into at least one outer fiber layer of the drilling anchor. The invention also relates to a method for producing such a drilling anchor.

15 Claims, 1 Drawing Sheet

FIBER REINFORCED PLASTIC DRILLING ANCHOR

Figure 1:
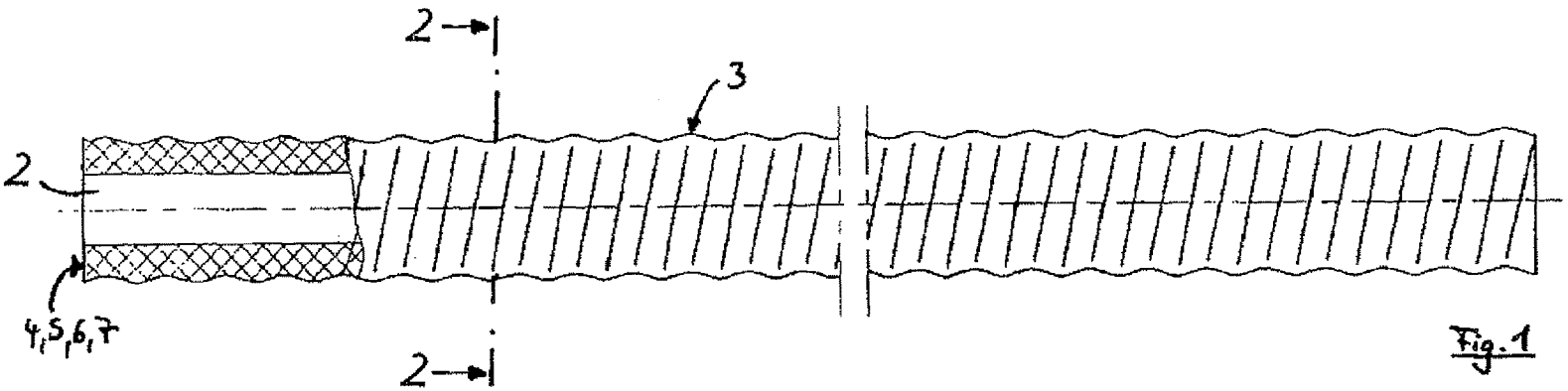

The present invention relates to a drilling anchor. Such drilling anchors are made of fibre-reinforced plastic, where fibers running in the longitudinal direction of the drilling anchor and fibers running at an angle to the longitudinal direction of the drilling anchor are embedded in a plastic matrix. In order to be able to use the drilling anchor as an injection drilling anchor as well, they are provided with a central channel which is formed through an axial boring running along the entire length of the drilling anchor.

Drilling anchors are generally known as so-called "self-drilling" anchors (SB anchors) also. They are used primarily in mining or in tunnel construction for securing construction elements, such as roofs or walls. In particular, one uses them if the rocks, mountains or stones are brittle and the drilling anchor hole is so unstable that it collapses even during the drilling or after drawing the standard drilling rods and a conventional anchor cannot be used. The drilling anchors thus combine the function of the drilling rod, which in conjunction with a hammer drill or a rotary drill conventionally serves to drill holes, with the function of the anchor set up subsequently in the drilled holes, so that the withdrawal of the drilling rod and the breakdown of the drilled hole wall can be avoided. The drilling anchor in this case is provided with a drill bit in front and connected behind with a drilling machine or a drilling apparatus. After the drilling, injection material is pressed into the drilled hole through the inner canal of the drilling anchor, and a clamping nut is tightened on the projecting pipe end, which presses a pressure plate against the drilled hole walls. The drilling anchor in this case remains as a hidden drilling anchor in the drilled hole.

Such drilling anchors were first known only as made of steel pipe. In temporary uses, or where higher corrosion protection is required, plastic systems come into use in place of steel pipes, labelled internationally as the "FRP System" (FRP=Fibre Reinforced Plastic). Thus drilling anchors of the type noted at the outset are suggested of fiber reinforced plastic. They are not only resistant to corrosion, but by being lighter they are more easily handled and are comparatively cheap, so that as a result the corrosion problems can be combated effectively and for the long run with small expense. In addition, such fiber-reinforced plastic drilling anchors can also be removed without problem in a later dismantling of a fastened wall.

Fibre reinforced plastics present fiber composite material in which the plastic is combined with fibers made of another material in order to obtain positive synergistic effects and improved properties of the plastic in the desired direction, primarily mechanical improvements. Examples of use of fibers are glass fibers, aramid fibers, carbon fibers, silicon carbide fibers, and boron fibers, which preferentially are embedded in the plastic in the longitudinal direction of a rod profile with what is called unidirectional fiber orientation. A matrix of plastic resin surrounds a number of fibers oriented parallel to each other, having for example a diameter of 10 to 30 μm. In this way the fibers give the composite material its great strength in the longitudinal direction, while the resin matrix serves to fix the fibers in position and simultaneously to protect them from damaging influences.

A multi-layered rope anchor is known from DE 40 18 703 C1, in which a rope made of textile yarn is surrounded by a support netting and which can contain an inner core. In order to achieve an inner binding of these layers to each other, an outer protective mantel made of plastic is also provided. Such a rope anchor, however, cannot be used as a drilling anchor for the cases of use noted at the outset, since aside from a missing outer thread, neither a transfer of the high torque nor an effective transmission of the impact energy of the drill hammer up to a drill bit mounted on the foot of the anchor is possible. Further as a flexible anchor with its rope-type construction, it is designed for drumming as endless material, which can be introduced only into already prepared drilled holes.

Further a mountain anchor made of plastic is known from DE 295 01 694 U1, made of synthetic materials and arranged in layers lying one over another. Here the anchor can be used as a hollow anchor as well for injection. However, because of its lack of stiffness, this mountain anchor too is not suitable for drilling, since it is designed as a flexible system in order to keep movements in sedimentary stone and convergences in limits, which is comparable to steel with increased ductility. Regardless of this, the mountain anchor also has no outside profiling and no outer thread, and for this reason also it cannot be used as a drilling anchor.

In addition, fiber reinforced plastic drilling anchors of the type noted at the outset are known from WO 96/21087. On either end they have a limited thread in the axial circumference. These drilling anchors have both spiral-shaped wound fibers and longitudinal fibers.

Disadvantage in these already known drilling anchors is only a limited binding effect in pressed concrete or other surrounding medium or surrounding rock. Besides, the loads that occur during drilling can lead to damage to the drilling anchors, despite the double layered fiber construction.

The task of this invention is therefore to create an improved drilling anchor of the type noted at the outset of fiber reinforced plastic, which can better absorb the complex tensions that arise during the drilling operation and the forces resulting from that operation. In addition, a multi-functional operable drilling anchor is created that has a sufficient hydraulic strength for rinsing with drilling water and the subsequent high pressure injection with very high pressures, and at the same time one that can compensate for complex tensions and loads introduced into the anchor in the pre-broken rocks.

According to the invention, this task is solved by a drilling anchor according to claim 1. Advantageous embodiments and other forms of the invention follow from the dependent claims.

It is important in the invented solution that a first layer of fibers that extend at an angle to the longitudinal direction of the drilling anchor is surrounded by a second layer of fibers extending in the longitudinal direction of the drilling anchor, and the second layer of fibers is surrounded by a third layer of fibers extending at an angle to the longitudinal direction of the drilling anchor and that the drilling anchor has a thread extending over its entire length which is formed into at least one outer fiber layer of the drilling anchor.

The main advantage here lies in the fact that an essentially multifunctional operable drilling anchor is created, which assures a significantly higher load bearing ability with greater durable safety. In particular the complex loads and resulting forces that appear during the drilling process can be basically better absorbed, particularly the tensile forces due to axial compression and torsion, such as from friction and cutting. Also substantially higher hydraulic pressures due to rinsing with drilling water can be absorbed without damage to the drilling anchor; also particularly in associated high-pressure injections, such as with the 2-K systems and pressures over 300 bar; at the same time, compensation can be made for the complex tension and loading of the anchor due to tensile, drawing, and cutting forces in the rocks.

The invented drilling anchor can be manufactured economically because of simple construction and is easy to handle due to its light weight. Moreover, optimal corrosion protection is assured even in long duration uses.

It is particularly advantageous if the third fiber layer is surrounded by at least a fourth fiber layer. In this way, even greater strength and an optimum design of the drilling anchor is achieved with regard to the loads that occur.

Further, it is particularly advantageous if the first and/or the third fiber layer has fibers that are wound in spiral shape at an angle between 30° and 60°, and especially between 40° and 50°, preferably at an angle of some 45° to the longitudinal direction of the drilling anchor.

It is further particularly advantageous if the first and/or third fiber layer has a first group of fibers that are wound in a first rising orientation at an angle between 30° and 60° to the longitudinal direction of the drilling anchor, and also has a second group of fibers, which are wound at an angle between 30° and 60° to the longitudinal direction of the drilling anchor in the opposite rising orientation. The two groups of fibers can be fixed here either separate from each other or mixed with each other.

It is further particularly advantageous if the fibers of individual fiber layers are embedded in plastic, which is separate from the plastic of the adjoining fiber layers.

Similarly the fibers of individual fiber layers may advantageously be made from one material, which is different from the material of the adjoining fiber layers.

It is further particularly advantageous if the first and/or the third fiber layer has fibers running at an angle to the longitudinal direction of the drilling anchor which are embedded in Vinylester resin. The embedding of the fibers bordering on the inner canal in Vinylester resin serves advantageously to increase the chemical resistance of the drilling anchor.

The second fiber layer is preferably embedded in epoxy resin with the fibers running in the longitudinal direction of the drilling anchor. They thus allow an optimal transfer of the drawing and pressure forces even with an impulse type arising impact load.

It is further particularly advantageous if the fibers of the first and/or the second fiber layer are glass fibers. The fibers of the third fiber layer are preferably carbon fibers. In this way very high torque and very high impact energy from the drill hammer used to insert the drilling anchor can be transmitted effectively via the drilling anchor up to a drill bit mounted on the anchor foot, whereby the risk of breaking of the anchor is reduced to a minimum.

It is further particularly advantageous if the fourth fiber layer has glass fibers, which are preferably embedded in epoxy resin. The thread can be formed without cutting the fibers in this fiber layer or in other outer fiber layers of the drilling anchor also. In this way a high strength thread is achieved without cuts and thus without any destruction of the fibers which creates an optimal binding effect to its environment with its length in accordance with the invention.

It is further particularly advantageous if the drill anchor has in volume a minimum of 80% fiber share and a maximum of 20% of plastic resin share. In this way optimal strength values are achieved with respect to all loads that appear.

It is further particularly advantageous if the thread of the drilling anchor is provided with a hardened protective layer. The protective layer may consist in particular of a hardened gel as top coating and should serve not merely as mechanical protection, but also as UV protection and in particular acid protection of the thread.

This invention further concerns a process for manufacturing a drilling anchor of the type described previously. According to this the drilling anchor is manufactured by pultrusion in several layers with separated layers, whereby despite the improved qualities of the drilling anchor, economical and simple production is made possible.

Other advantages and characteristics of the invention result from the following description and from the implementation examples presented in the drawings.

Figure 2:
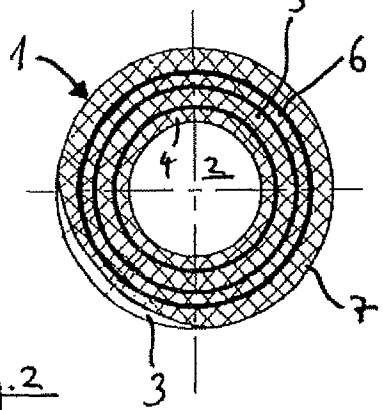

Shown are:

FIG. 1: A partially cut side view of an invented drilling anchor;

FIG. 2: Cross-section along the cut line 2-2 of FIG. 1; and

Figure 3:
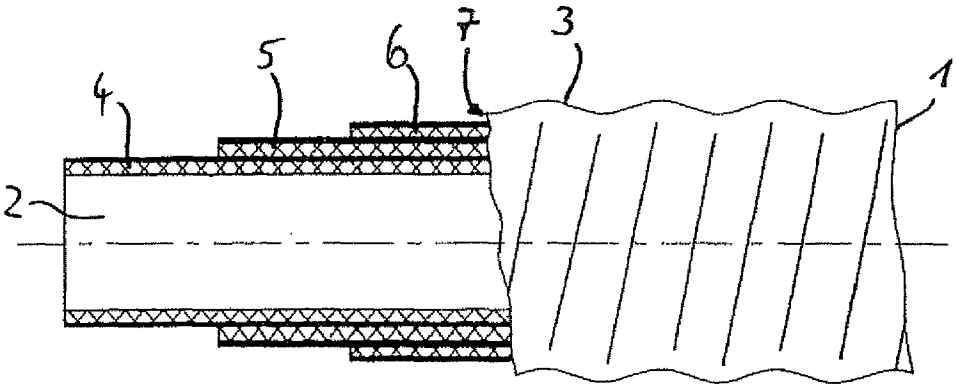

FIG. 3: Enlarged, partially cut schematic presentation of the construction of an invented drilling anchor.

The drilling anchor 1 presented in the figures is made from a fibre-reinforced plastic that is built up in several layers. The drilling anchor 1 has an axial bore 2 that runs along the entire length and an outer thread 3 with a wave-like contour that also runs along the entire length.

With laminating done in layers or coats, the fibers or the groups of fibers are not only arranged parallel or unidirectional, but especially in the topmost layer are embedded in the resin matrix wound or twisted in the opposite direction from the direction of the winding thread and of the drill.

In the variants of the embodiment presented here, for purposes of increasing the hydraulic stability, two groups of glass fibers are embedded in Vinyl resin in a first fiber layer 4 with simultaneously high mechanical and chemical resistance. These two groups of the first fiber layer 4 are each wound at an angle of 45° to the axial orientation of the drilling anchor 1 and run opposite to each other.

Built on this, a second fiber layer 5 of glass fibers is embedded in Epoxy resin in the longitudinal direction of the drilling anchor 1. This layer serves to receive the high mechanical axial drawing and pressure forces.

In a third fiber layer 6 lying outside on these, carbon fibers are embedded in Vinylester resin opposite to the turning and drilling direction of the outer thread 3. These take over the special reaction forces from the drilling work. At the same time, through the accepting Vinylester resin they offer permanent protection for the glass fibers in the core against external chemical effects.

In a final outer closing lamination 7, formed of glass fibers in epoxy resin, is formed the high strength thread 3 without destruction to the glass fibers that run through it.

Injection is done through the drilling anchor 1 after the drilling via various adapter systems. With cement mortar this is not critical, since no high injection pressures and hardly any reaction pressures appear; no mixing is done at high energies either on or in drilling anchor 1 or pressure maintained and the drilling hole itself must not be held closed in an elaborate manner. With two-component mortars, however, well sealing adapter must be used with previously installed valves, integrated mixer, nozzle and backflow valve. For this, the anchor pipe 1 itself in general must be capable of bearing hydraulic loads of about 250 bar working pressure or standard pressure (350 bar bursting pressure). This ability to bear pressure is achieved through the invented embodiment of the drilling anchor 1.

Because of the anisotropy of the fiber composite material, a self-drilling FRP anchor 1 for right turning, rotary drilling has a limited torsion resistance in comparison to steel pipes. Despite this in order to work with the high pressure force (5-20 kN) needed for rotating drilling on one side and the required high torque (300 Nm) on the other side, the invented drilling anchor is optimized with regard to the resin properties, the quality of the fibers and the orientation of the fibers.

In plastic pipe 1, made of several fibre-reinforced layers, one or several unidirectional fiber courses 5 and one or several wave-form bound fiber courses 4, 6 with the same and/or different directions and equal or different amounts of rise may be combined in any desired form independent of each other according to the need. In particular, on the upper surface in the edge layer fibers 7 of the thread profile 3, the fibers can have an opposite direction fiber course so that as a result a right directed fiber course in the edge layer 7 is present with a left oriented thread profile for left drilling drills, and vice versa the plastic pipe 1 has a left directed fiber course in the edge layer 7 with a right oriented thread profile for right turning drills. Here is provided preferably the same rise by which the geometry of the left or right oriented thread profile each is thread compatible with diverse standard accessories from the left rotating impact drilling area or from the right rotating impact drilling area. In addition, the through-going thread profile 3 shows optimally excellent binding properties with rib surface in both mortars and in concrete.

The invention claimed is:

1. Drilling anchor of fiber-reinforced plastic, with an axial bore (2) that runs along its entire length, in which the drilling anchor (1) has fibers running in the longitudinal direction of the drilling anchor (1) and fibers running at an angle to the longitudinal direction of the drilling anchor (1), wherein a first fiber layer (4) of fibers running at an angle to the longitudinal direction of the drilling anchor (1) is surrounded by a second fiber layer (5) with fibers running in the longitudinal direction of the drilling anchor (1)

and that the second fiber layer (5) is surrounded by at least a third fiber layer (6) with fibers running at an angle to the longitudinal direction of the drilling anchor (1), and that the drilling anchor (1) has a thread extending over its entire length (3), which is formed into at least one outer fiber layer (6, 7) of the drilling anchor (1).

2. Drilling anchor according to claim 1, wherein the third fiber layer (6) is surrounded by at least a fourth fiber layer (7).

3. Drilling anchor according to claim 1, wherein the first and/or the third fiber layer (4, 6) comprise fibers that are wound in spiral form at an angle between 30° and 60° , in particular between 40° and 50° to the longitudinal direction of the drilling anchor.

4. Drilling anchor according to claim 3, wherein the first and/or the third fiber layer (4, 6) each has a first group of fibers that are wound in a first rising orientation at an angle between 30° and 60° to the longitudinal direction of the drilling anchor (1) as well as a second group of fibers that is wound at an angle between 30° and 60° to the longitudinal direction of the drilling anchor in the opposite rising orientation.

5. Drilling anchor according to claim 1, wherein the fibers of individual fiber layers are embedded in plastic that is different from the plastic of the adjoining fiber layers.

6. Drilling anchor according to claim 1, wherein the fibers of individual fiber layers are made of a material that is different from the material of the adjoining fiber layers.

7. Drilling anchor according to claim 1, wherein the first and/or the third fiber layer (4, 6) comprises fibers running at an angle to the longitudinal direction of the drilling anchor which are embedded in Vinylester resin.

8. Drilling anchor according to claim 1, wherein the second fiber layer (5) comprises fibers running in the longitudinal direction of the drilling anchor which are embedded in Epoxy resin.

9. Drilling anchor according to claim 1, wherein the fibers of the first and/or second (4, 5) fiber layer are glass fibers.

10. Drilling anchor according to claim 1, wherein the fibers of the third fiber layer (6) are Carbon fibers.

11. Drilling anchor according to claim 1, wherein the drilling anchor (1) has regarding volume a minimum of 80% fiber content and a maximum of 20% plastic resin content.

12. Drilling anchor according to claim 1, wherein the thread (3) of the drilling anchor (1) is provided with a hardened protective coating.

13. Procedure for manufacture of a drilling anchor according to claim 1, wherein the drilling anchor (1) is manufactured multi-layered by pultrusion with separate layers (4, 5, 6, 7).

14. Drilling anchor of fiber-reinforced plastic, with an axial bore (2) that runs along its entire length, in which the drilling anchor (1) has fibers running in the longitudinal direction of the drilling anchor (1) and fibers running at an angle to the longitudinal direction of the drilling anchor (1), wherein a first fiber layer (4) of fibers running at an angle to the longitudinal direction of the drilling anchor (1) is surrounded by a second fiber layer (5) with fibers running in the longitudinal direction of the drilling anchor (1)

and that the second fiber layer (5) is surrounded by at least a third fiber layer (6) with fibers running at an angle to the longitudinal direction of the drilling anchor (1), and that the drilling anchor (1) has a thread extending over its entire length (3), which is formed into at least one outer fiber layer (6, 7) of the drilling anchor (1), wherein the thread (3) is formed without cutting the fibers in the outer layer or cuts in the fibers of the outer layer.

15. Drilling anchor of fiber-reinforced plastic, with an axial bore (2) that runs along its entire length, in which the drilling anchor (1) has fibers running in the longitudinal direction of the drilling anchor (1) and fibers running at an angle to the longitudinal direction of the drilling anchor (1), wherein a first fiber layer (4) of fibers running at an angle to the longitudinal direction of the drilling anchor (1) is surrounded by a second fiber layer (5) with fibers running in the longitudinal direction of the drilling anchor (1)

and that the second fiber layer (5) is surrounded by at least a third fiber layer (6) with fibers running at an angle to the longitudinal direction of the drilling anchor (1), and that the drilling anchor (1) has a thread extending over its entire length (3), which is formed into at least one outer fiber layer (6, 7) of the drilling anchor (1) by pultrusion without cutting the fibers in the outer layer or without cuts in the fibers of the outer layer.

* * * * *